United States Patent [19]

LaBounty

[11] 4,413,945

[45] Nov. 8, 1983

[54] GRAPPLE RAKE FOR BACKHOE

[76] Inventor: Roy E. LaBounty, 1607 - 8th Ave., Two Harbors, Minn. 55616

[21] Appl. No.: 305,946

[22] Filed: Sep. 28, 1981

[51] Int. Cl.[3] ..... B66C 3/16

[52] U.S. Cl. ..... 414/739; 294/106

[58] Field of Search ..... 414/739, 685, 722, 729; 294/88, 106

[56] References Cited

U.S. PATENT DOCUMENTS

| | | | |
|---|---|---|---|
| 3,802,731 | 4/1974 | LaBounty | 294/88 |
| 4,104,792 | 8/1978 | LaBounty | 30/134 |
| 4,182,593 | 1/1980 | Sweet | 294/88 |
| 4,248,471 | 2/1981 | LaBounty | 294/88 |

FOREIGN PATENT DOCUMENTS

| | | | |
|---|---|---|---|
| 676232 | 7/1979 | U.S.S.R. | 414/739 |

*Primary Examiner*—Robert J. Spar
*Assistant Examiner*—Donald W. Underwood
*Attorney, Agent, or Firm*—Peterson, Palmatier, Sturm, Sjoquist & Baker, Ltd.

[57] ABSTRACT

This invention relates to an attachment for the dipper stick of a backhoe and more particularly relates to a grapple rake for mounting on the end of the dipper stick.

5 Claims, 6 Drawing Figures

GRAPPLE RAKE FOR BACKHOE

BACKGROUND OF THE INVENTION

Grapple-like tools attachable to the dipper stick of a backhoe have been known previously and have been particularly useful for loading various types of materials into a truck or gathering materials and placing them in a pile on the ground for future handling. For actual raking along the ground so as to clean debris off a site, the previously known grapples have had limited usefulness, primarily because the lower jaw has the teeth curved in the wrong direction and furthermore, the lower jaw is effectively in the way of using the upper jaw for efficient raking over the surface of the ground. Two earlier patents illustrate prior grapples which are constructed so that raking of debris along the surface of the ground cannot be efficiently carried out. In U.S. Pat. No. 3,802,731, the lower jaw is mounted on the end of the dipper stick, but illustrates a rigid strut which prevents swinging of the lower jaw. In some instances, the rigid strut retaining the lower jaw is replaced with a hydraulic cylinder, but primarily for the purpose of closing the lower jaw toward the upper jaw, and as a result the lower jaw continues to be in the way for efficient raking through the use of a top jaw.

In U.S. Pat. No. 4,248,471, another grapple assembly is illustrated and in this form the lower jaw is swingable relative to the dipper stick and the strut, but the attachment to the inner end of the upper jaw is spaced from the pivot on the dipper stick so that as the upper jaw is swung downwardly into a suitable raking position, the lower jaw is clearly in the wrong position so that the upper jaw can be used as a rake.

None of the other prior art presents any more suitable solution to an efficient raking function than is illustrated by these two patents.

SUMMARY OF THE INVENTION

An object of the invention is to provide a new and improved grapple-type tool for attachment to the dipper stick of a backhoe and which may be efficiently employed in a raking operation for cleaning debris off the surface of the ground being worked upon.

Another object of the invention is to provide a novel grapple-type tool attachable to the dipper stick of a backhoe which has upper and lower jaws with tines so that they may be used for grasping, lifting, and handling various types of debris and other materials and wherein the lower-toothed jaw may be swung out of the way so that the upper jaw can be efficiently used for raking purposes by swinging the upper jaw downwardly and then manipulating the boom and dipper stick of the backhoe.

An important feature of the present invention is the mounting of the lower grapple jaw directly upon the dipper stick of the backhoe with the use of rearwardly protruding ears which are pinned to the dipper stick. These same ears of the lower jaw carry a mounting shaft spaced from the pin and swingable around the end of the dipper stick. Mounting ears on the upper jaw are swingably carried on the swingable shaft and are confined by additional stationary ears on the lower jaw. The ears on the lower jaw which are pinned to the dipper stick protrude to the rear of the lower jaw so that a cylinder extending along the dipper stick can retract the lower jaw to lie almost flush along the bottom side of the dipper stick; and a separate hydraulic cylinder will operate the upper jaw to swing it downwardly into raking position while the lower jaw is entirely out of the way.

The advantages of this construction are clear in that the upper jaw can be efficiently used in a raking operation by swinging the dipper stick so as the draw the tips of the tines on the upper jaw along the surface of the ground while the lower jaw is entirely out of the way so as to avoid interfering with the raking operation.

DETAILED SPECIFICATION

Figure 1:
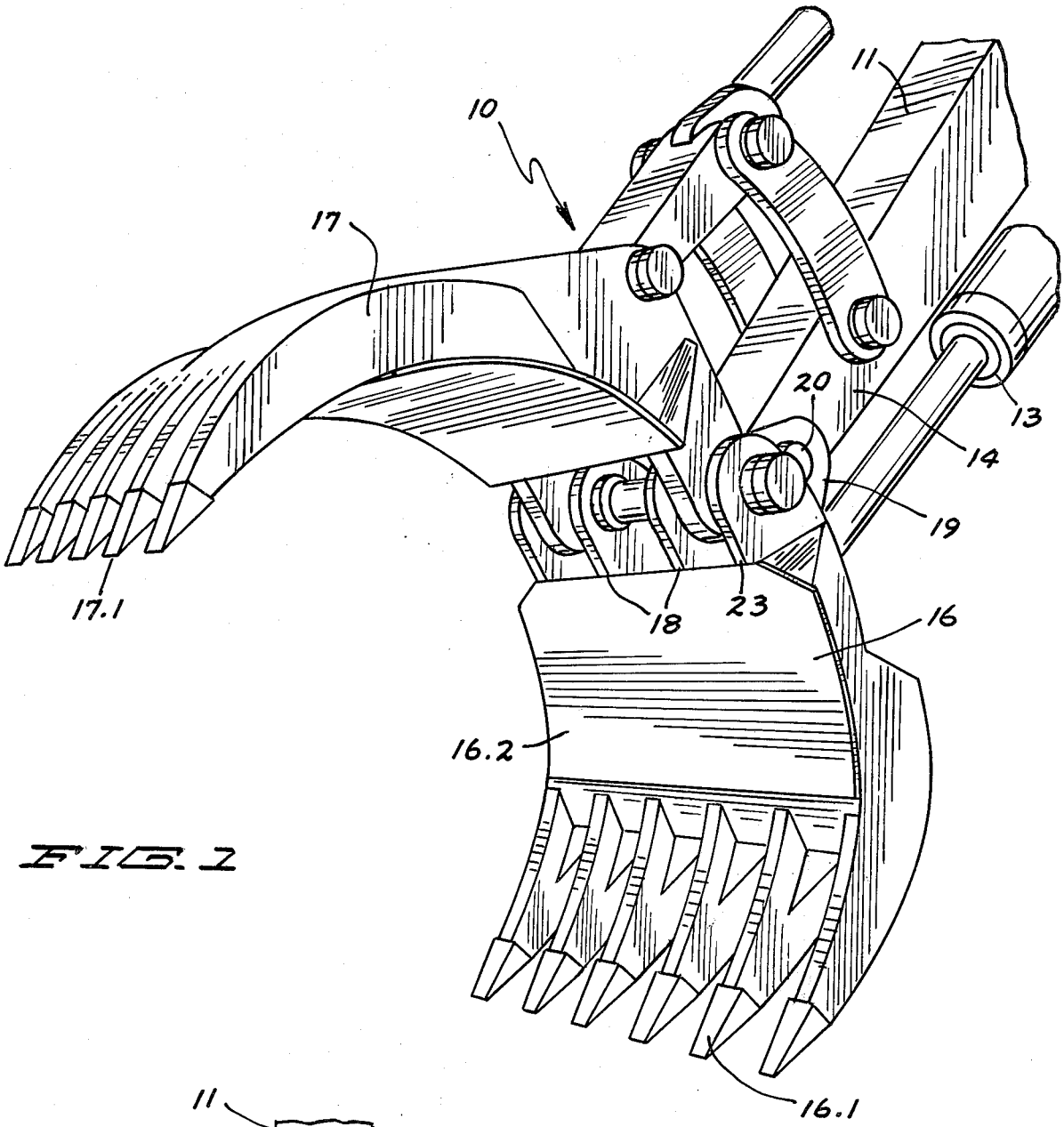
FIG. 1 is a perspective view of the tool attached to the dipper stick of the backhoe.
Figure 4:
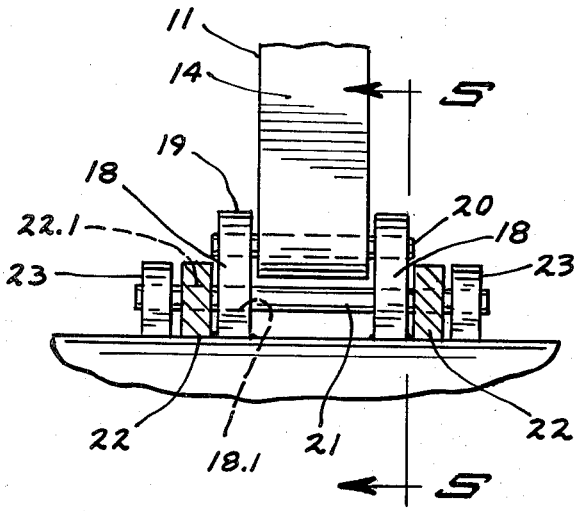
FIG. 4 is a detail section view taken approximately at 4—4 of FIG. 2.

One form of the invention is shown in the drawings and is described herein.

The grapple rake is indicated in general by numeral 10 and is to be mounted on the dipper stick 11 of a backhoe. It will be recognized that the dipper stick of a backhoe is a rigid member swingable about a horizontal axis at its upper or rear end and attached to the boom of the backhoe which is also swingable about a horizontal axis at its rear or lower end which is attached to the swing house of the backhoe. The dipper stick 11 of the backhoe has hydraulic cylinders 12 and 13 respectively positioned above and below the dipper stick and adjacent its outer end 14. The piston rod 12.1 of the upper cylinder is attached to a swinging link 15 which is pivotally mounted on the dipper stick 11, adjacent the other end thereof.

The grapple rake 10 includes a back jaw 16 and a front jaw 17. Both of the jaws 16 and 17 have tines 16.1 and 17.1, and both of the jaws 16 and 17 also have load-engaging plates 16.2 and 17.2 spaced inwardly from the outer ends of the tines and traversing the spaces between the tines.

The upper end of the back jaw 16 has a pair of upstanding and rigid mounting ears 18 thereon. The mounting ears 18 are rigid with the entire lower jaw 16 which comprises an integral weldment. The mounting ears 18 have rearwardly protruding portions 19 which receive the end 14 of the dipper stick 11 therebetween in close fitting relation. Mounting apertures 19.1 in the rearwardly protruding portions 19 of the ears receive a pivot pin 20 therethrough which also extends through the mounting aperture or bearing opening in the end 14 of the dipper stick. The ends of the pin 20 lie substantially flush with the sides of the rearwardly protruding portions 19 of the ears.

The mounting ears 18 on the lower jaw also have apertures 18.1 therein which receive and carry a swing shaft 21 extending through the apertures. The inner end 17.3 of the front jaw has a pair of depending ears 22 affixed thereon. The depending ears 22 are spaced from each other to receive the mounting ears 18 of the back jaw therebetween in close fitting confronting relation therewith. The depending ears 22 have bearing apertures 22.1 therein which receive the swing shaft 21 therethrough for effectively mounting the front jaw 17 on the swing shaft 21 and on the mounting ears 18 of the back jaw.

The back jaw 16 also has a second pair of upstanding shaft mounting or supporting ears 23 with apertures 23.1 therein also receiving the ends of the shaft 21.

The piston rod of the lower hydraulic cylinder 13 is attached to the back jaw 16 by a pivot pin 24. The piston rod 12.1 and the link 15 are pivotally connected to the front jaw by a second link 25 and a pivot pin 26.

Figure 2:
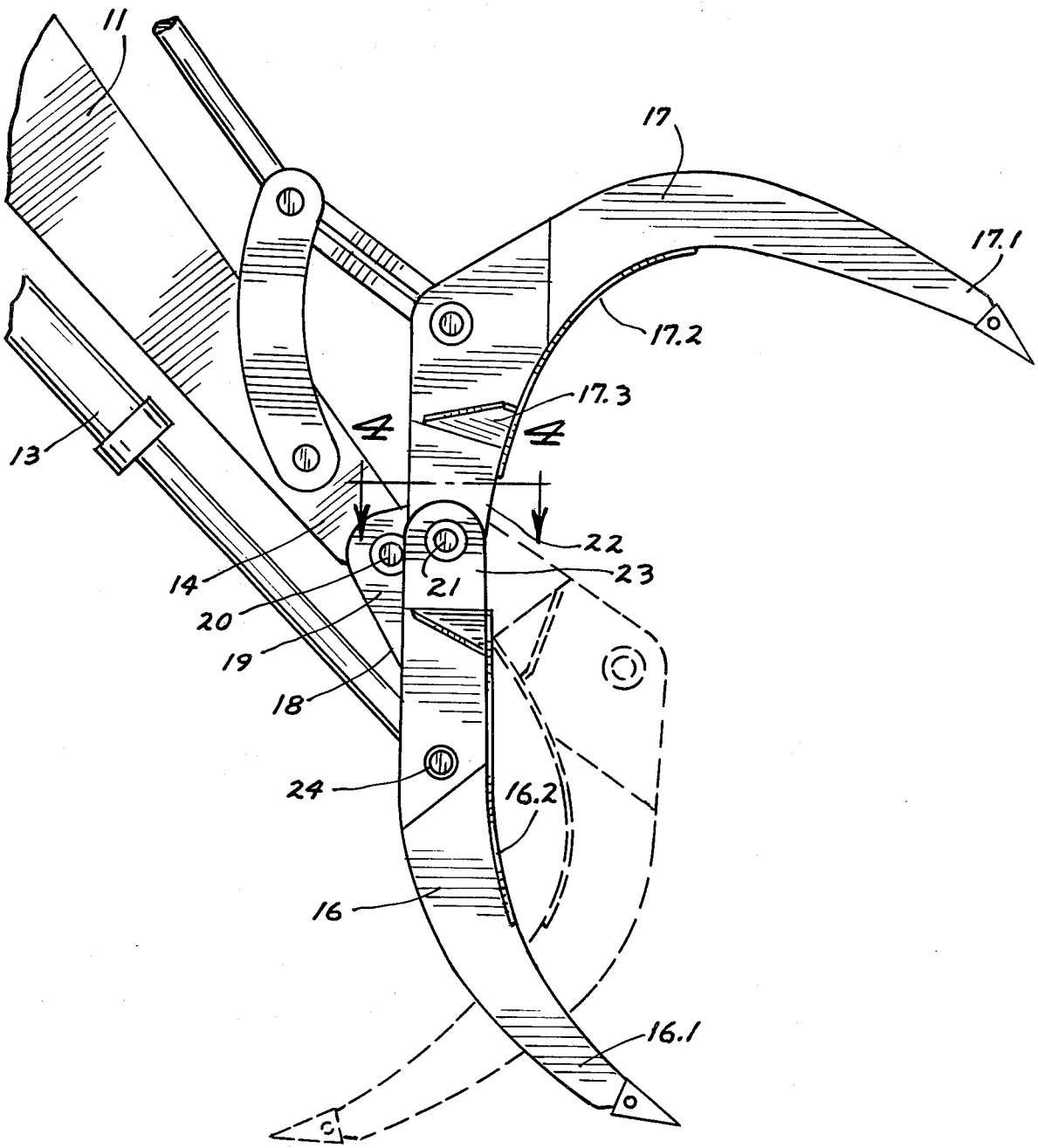
FIG. 2 is a side elevation view showing a shifted position of the top jaw.

In operation, it will be recognized that the front and back jaws may be conventionally operated and swung toward each other for gripping articles or debris in the full line position of the lower jaw 16 in FIG. 2, and the dotted line position of the upper jaw 17 in the same figure. As the lower cylinder 13 is operated, the back jaw 16 swings on the pivot pin 21 relative to the dipper stick 11. The swing shaft 21 also swings about the pivot pin 20 as the back jaw 16 is swung, as to reorient the front jaw 17.

Figures 3, 5, 6:
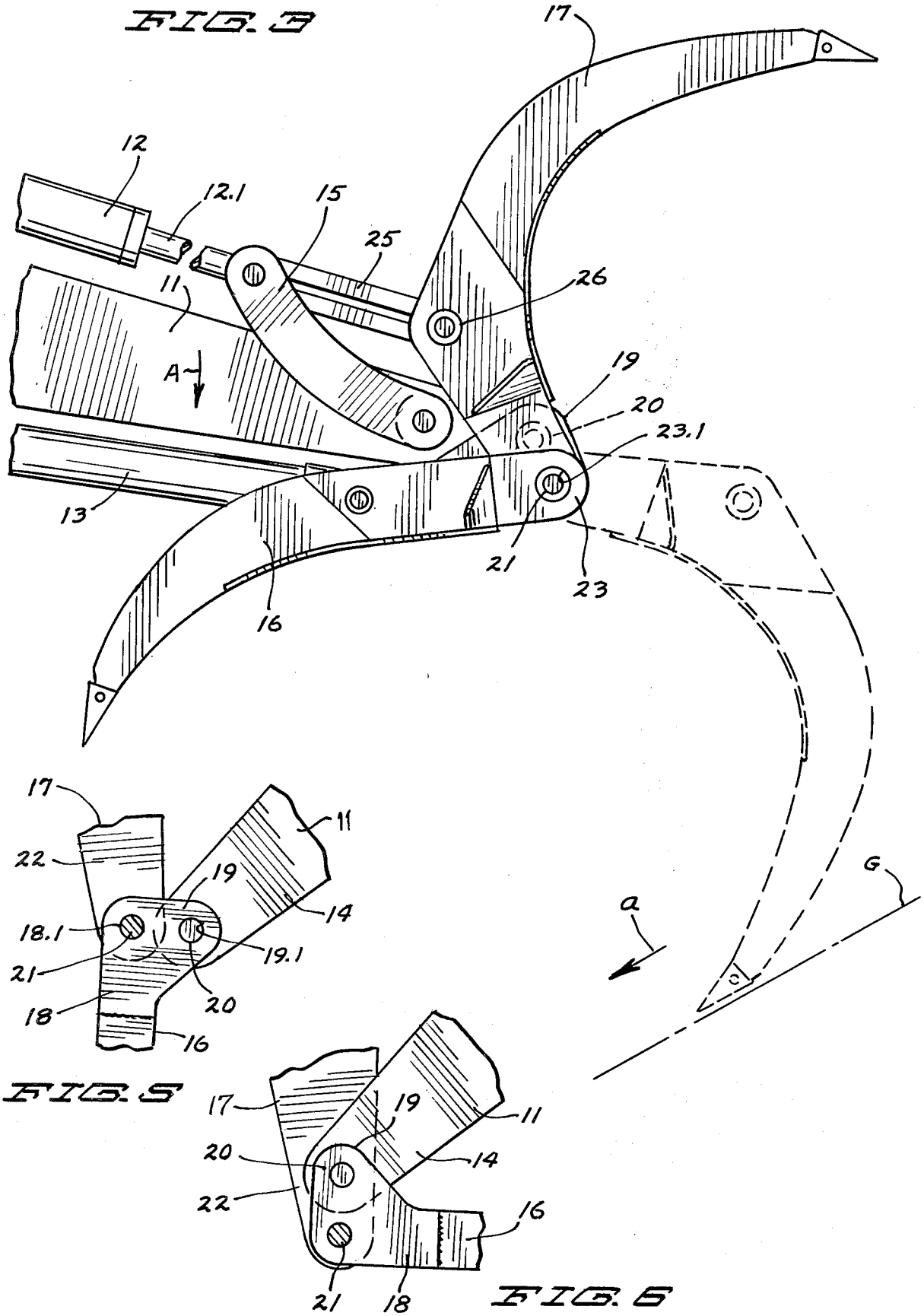
FIG. 3 is another side elevation view illustrating the bottom jaw fully retracted and laid back against the dipper stick in an out-of-the-way position.
FIG. 5 is a detail section view taken approximately at 5—5 of FIG. 4.
FIG. 6 is a view similar to FIG. 5 but with the components thereof in shifted position.

As the top cylinder 12 is operated, the front jaw 17 swings about the pivot 21 from the full line positions in FIGS. 2 and 3 to the dotted line positions therein.

It is important to note that the back jaw 16 is capable of swinging so that its rear side will lie substantially flush against the bottom side of the dipper stick, substantially in the manner illustrated in FIG. 3. In this position, the back jaw 16 has its tines well up and out of the way so that the front jaw 17 may be swung outwardly and downwardly toward the dotted line position of either FIGS. 2 or 3 so that the grapple rake 10 may be used for raking along the ground surface which is indicated in general by the dotted line G in FIG. 3. The debris and other materials on the ground surface may be moved by the front jaw 17 in the direction of Arrow a as the dipper stick 11 is swung in the direction of Arrow A seen in FIG. 3.

It is clear that substantial advantage is obtained in being able to rake with the front jaw 17 while the back jaw is entirely out of the way so that all of the debris on the ground surface can be accumulated so that it can be either stacked or picked up and loaded into a truck. When the dipper stick 11 is tilted to an almost upright angle as illustrated in FIG. 2, and while the back jaw 16 will lie flush against the bottom side of the dipper stick, the back jaw 16 will not obscure the vision of the operator of the machine while he continues to rake with the front jaw 17.

I claim:

1. A grapple rake for attachment onto the end of the dipper stick of a backhoe, comprising a single generally upright back jaw to traverse the dipper stick and having upper and lower ends, lateral edges and front and back sides, the front side being concavely curved, a swingable front jaw to traverse the end of the dipper stick and having inner and outer ends, lateral edges and front and back sides, the front side being concavely curved to cooperate with the back jaw, attachment means of the upper end of the back jaw and on the inner end of the front jaw and including a swing shaft for swingably interconnecting the jaws together, positioning means on the jaws and dipper stick for swinging both jaws relative to the dipper stick, a pair of parallel mounting ears on the back jaw with apertured portions protruding rearwardly of the back side of the back jaw in a spaced relation to each other to receive the end of the dipper stick therebetween, and the apertured portions having a pivot pin in the apertures thereof and extending through the dipper stick to pivotally carry the back jaw and permit the back to lie against the dipper stick while the front jaw is used for raking, the mounting ears having inner faces confronting each other at the end of the dipper stick therebetween and also having outer faces, and a pair of rigid depending ears on the inner end of the front jaw and respectively facing the outer faces of said adjacent mounting ears at opposite sides of the dipper stick, the swing shaft swingably connecting the depending ears with the mounting ears and being movable around the end of the dipper stick as the back jaw is swung, the front jaw thereby being adapted to swing through a full range of opening and closing regardless of whether the back jaw is oriented transversely of the dipper stick or is laid back along the dipper stick.

2. The grapple rake according to claim 1 and the attachment means including forward portions of said mounting ears, the swing shaft extending through the forward portions of the ears.

3. The grapple rake according to claim 2 and the depending ears being swingable transversely across and in spaced and confronting relation to the ends of the pivot pin to accommodate significant swinging of the front jaw while the back jaw is laid back against the dipper stick.

4. The grapple rake according to claim 3 and including a second pair of shaft mounting ears on the back jaw and spaced from and confronting the mounting ears to receive the depending ears of the front jaw therebetween.

5. The grapple rake according to claim 1 and said positioning means including separate hydraulic cylinders respectively attached to the front and back jaws for producing controlled swinging thereof.

* * * * *

UNITED STATES PATENT AND TRADEMARK OFFICE

CERTIFICATE OF CORRECTION

PATENT NO. : 4,413,945

DATED : November 8, 1983

INVENTOR(S) : Roy E. LaBounty

It is certified that error appears in the above-identified patent and that said Letters Patent is hereby corrected as shown below:

Column 4, line 20, after "back", insert --jaw--.

Signed and Sealed this

*Twenty-first* Day of *February 1984*

[SEAL]

*Attest:*

GERALD J. MOSSINGHOFF

*Attesting Officer*

*Commissioner of Patents and Trademarks*